United States Patent [19]

Saito

[11] 4,242,445

[45] Dec. 30, 1980

[54] METHOD FOR PREPARING LIGHT-SENSITIVE SILVER HALIDE GRAINS

[75] Inventor: Mitsuo Saito, Minami-ashigara, Japan

[73] Assignee: Fuji Photo Film Co., Ltd., Minami-ashigara, Japan

[21] Appl. No.: 2,134

[22] Filed: Jan. 9, 1979

[30] Foreign Application Priority Data

Feb. 2, 1978 [JP] Japan ..... 53-10681

[51] Int. Cl.[3] ..... G03C 1/02

[52] U.S. Cl. ..... 430/569; 430/567

[58] Field of Search ..... 96/94 R, 108, 114.7; 260/114

[56] References Cited

U.S. PATENT DOCUMENTS

| | | | |
|---|---|---|---|
| 3,650,757 | 3/1972 | Irie et al. | 96/94 R |
| 3,672,900 | 6/1972 | Kurz | 96/108 |

OTHER PUBLICATIONS

Making & Coating Photographic Emulsions, Zelikman et al., Focal Press, N.Y., ©1964, pp. 82–87, 125, 130–141.

*Primary Examiner*—Travis Brown

*Attorney, Agent, or Firm*—Sughrue, Rothwell, Mion, Zinn and Macpeak

[57] ABSTRACT

A method of preparing light-sensitive silver halide grains by the simultaneous addition of two or more aqueous solutions of inorganic salts in the presence of a protective colloid, in which the production of silver halide nuclei is brought to completion during the initial stages of grain formation and the concentrations of the aqueous solutions of inorganic salts reacting with one another are increased to such an extent that fresh nuclei of crystal grains are hardly produced during the period of grain growth. The process provides grains having a desired size, for which there exists a narrow size distribution, in a relatively short period of time and which avoids any abrupt increase in the flow rates of aqueous solutions of inorganic salts added to a reaction vessel during the final stage of grain growth.

13 Claims, 2 Drawing Figures

METHOD FOR PREPARING LIGHT-SENSITIVE SILVER HALIDE GRAINS

BACKGROUND OF THE INVENTION

1. Field of the Invention

The present invention relates to a method of preparing light-sensitive silver halide grains and, particularly, to the method of growing crystal grains of light-sensitive silver halides.

2. Description of the Prior Art

Light-sensitive silver halide grains are usually prepared by mixing two or more aqueous solutions of inorganic salts (a silver salt such as silver nitrate and at least one halide such as KBr, NaCl, KI, $NH_4Br$ and the like) in the presence of a protective colloid such as gelatin. Hitherto, when silver halide grains having uniform size and form are desired, the double jet method is carried out, in which two or more aqueous solutions of inorganic salts are simultaneously added to a reaction syste at a nearly constant rate. However, this method is inefficient because it requires a very long time for crystal grain growth. Therefore, the following improvements have been made in the method.

(1) The increase in grain size can be attained by the addition of a large amount of silver halide solvent such as ammonia, thiocyanates, thioethers or the like.

(2) The increase in grain size can be attained by increasing the addition amounts of each of the aqueous solutions of inorganic salts to such a rate that the addition amount varies proportionately to the rate of increase in the total surface area of silver halide grains produced or less than the rate of increase of the total surface area of silver halide. In accordance with the latter practice, the flow rate of the aqueous solution is allowed to increase according to the expression of $at^2+bt+c$, wherein t is time required for precipitate formation, and a, b and c are constants determined depending upon conditions for precipitate formation such as temperature and others. These improvements are described in detail in Japanese Patent Publication Nos. 36890/73 and 16364/77 (corresponding to U.S. Pat. Nos. 3,650,757 and 3,672,900, respectively), and the collection of preliminary reports published in autumn meeting of Japan Photographic Society in 1977, page 1.

The former method (1) suffers from the disadvantages that the formation of crystal grains is accompanied by side reactions of the silver halide solvent used, and it is difficult to change the pH in the vessel over a wide range because, for instance, when ammonia is employed as the silver halide solvent and it is desired to lower the pH by the addition of an acid, the action of the ammonia as the silver halide solvent is reduced.

The latter method (2) also has the defects that (a) the addition amounts must be sharply increased in the final stages of grain formation with the result that there is an abrupt increase in the quantity of liquid in a reaction vessel and it is difficult to achieve uniform stirring, and (b) the density of crystal grains (the number of crystal grains present in a volume of one liter) in the final stages of grain formation decreases and consequentially the critical rate of crystal grain growth decreases, the renucleation occurs easily and the size distribution is apt to widen, as described hereinafter, and (C) an elaborate apparatus capable of sharply varying the flow rate with great precision is required but is not easy to produce. In actual apparatuses, the flow rate can be varied within a limit of several ten-fold at the most. In particular, when the quantity of flow becomes very small, it is difficult to achieve the homogeneous mixing of solutions added.

SUMMARY OF THE INVENTION

Therefore, an object of the present invention is to provide a method of preparing light-sensitive silver halide grains having desired size and a narrow grain size distribution in a relatively short period of time.

Another object of the present invention is to provide a method for preparing light-sensitive silver halide grains in which in spite of the remarkably large addition amount of inorganic salts per unit time in the final stages of grain formation, compared with that in the initial stages, an abrupt increase in the flow rate into the reaction vessel is not required.

Other objects of the present invention will become more apparent from the following description of the invention and the appended claims.

The above-described objects are attained in a method of preparing light-sensitive silver halide grains by the simultaneous addition of two or more aqueous solutions of inorganic salts in the presence of a protective colloid by bringing the nucleation of silver halide crystal grains to completion at the initial stages of grain formation (i.e., at the period of nuclei formation), and by increasing the concentrations of the aqueous solutions of the inorganic salts to such an extent that fresh nuclei are hardly produced during the period of grain growth.

DETAILED DESCRIPTION OF THE INVENTION

Figure 1:
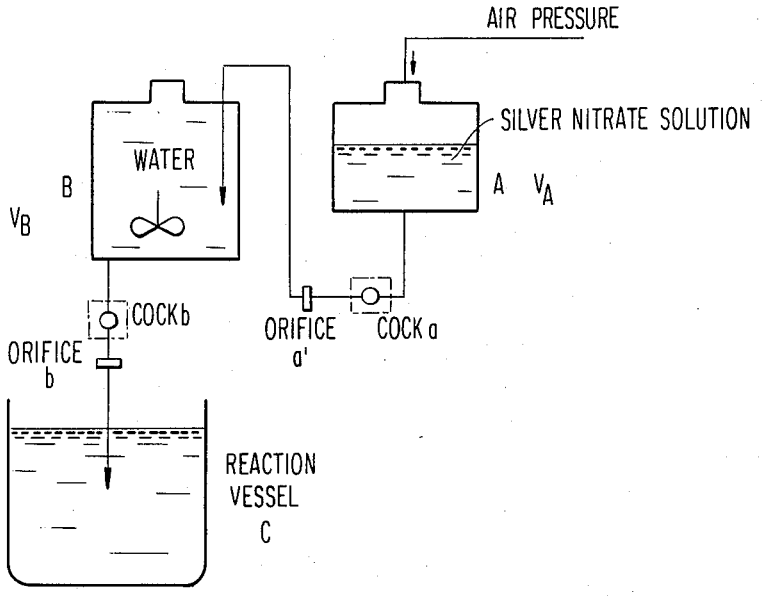
FIGS. 1 and 2 are schematic diagrams illustrating methods for continuously changing the concentration of an aqueous solution of silver nitrate.

In the present invention, light-sensitive silver halide grains are silver halide grains employed in photographic light-sensitive material, with specific examples including silver chloride, silver bromide, silver iodide, silver chloroiodobromide, silver iodobromide, silver chlorobromide and the like.

As a protective colloid employed in the present invention, gelatin is most advantageously used, but hydrophilic colloids other than gelatin can be also employed. Specific examples of such hydrophilic colloids include proteins such as gelatin derivatives, graft polymers of gelatin with other high polymers, albumin, casein, etc.; cellulose derivatives such as hydroxyethyl cellulose, carboxymethyl cellulose, sulfuric acid esters of cellulose and the like; sugar derivatives such as sodium alginate starch derivatives and the like; and a wide variety of synthetic hydrophilic macromolecular substances such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole and copolymers containing as the monomer units those monomers which constitute the above-described homopolymers. A concentration of hydrophilic colloid contained in a reaction vessel ranges preferably from 0.1 wt% to 30 wt% based on the water present in the reaction vessel.

For this disclosure, the terms "growth period of the crystal grains" or "grain growth" do not include the time between beginning the addition of the inorganic salt solutions and the completion of fresh nuclei production, but include only the grain formation period which occurs after nuclei formation when only grain growth continues and production of fresh nuclei rarely takes place. Stated differently, the period of "grain growth" does not include the period in which the nuclei are formed. The term "grain formation" as used in this specification includes "nuclei formation" and "grain growth" when crystal grains are produced and continuously followed by grain growth in the same reaction vessel and it also includes "grain growth" only when seed grains are previously prepared in a separate reaction vessel.

Whether the production of nuclei of crystal grains stops or not can be judged by actual electronmicroscopic examinations of specimens obtained by sampling on demand the reaction vessel in which the formation of silver halide grains takes place.

In practice, it is desirable that a period of producing fresh nuclei of crystal grains is less than 1/5 the time of the entire period of grain formation, namely, the entire period in which salt solutions are added to the reaction vessel, and particularly less 1/50 that period.

In the preparation of silver bromide grains carried out by adding an aqueous solution of silver nitrate and an aqueous solution of potassium bromide into a reaction vessel, the mechanism that extremely fine grains are produced continuously even during the period of grain growth, but they are only present temporarily and readily dissolve to become a source of ions for the crystal grains which grow stably is reported by C. R. Berry, in *Photographic Science & Engineering*, Vol. 20, pp. 1–4 (1976). The term "nuclei of crystal grains" in this specification does not include the above-described transient extremely fine grains, but only the crystal grains which are actually to be grown.

The above-described method corresponds to that for continuously growing crystal grains following the production of fresh nuclei. On the other hand, another method in which the nuclei for the crystal grains (hereinafter described as seed grains) are previously prepared in a separate reaction vessel may be employed. The size of such seed grains is not limited to a particular range, and can be arbitrarily selected depending upon the end-use of the crystal grains.

The most important feature of the present invention is that the concentrations of the aqueous solutions of inorganic salts added to bring about a double decomposition reaction are increased at the stage of crystal grain growth to such as extent that fresh nuclei of crystal grains are hardly produced. Such an increase in concentrations is used because the total surface area of crystal grains on which ions of inorganic salts can be deposited increases as grain growth progresses and deposition of larger amounts of the inorganic salt ions becomes possible.

The rate which the concentrations of the aqueous solutions of inorganic salts are increased in this case is determined based on various conditions such as the concentration of the colloid, the solubility of silver halide crystal grains, the stirring rate in a reaction vessel, the size and the density of crystal grains present at the time, the hydrogen ion concentration of the solution in the reaction vessel (pH), the silver ion concentration (pAg), and the ultimate size and distribution of crystal grains desired. The rate can be simply determined by one skilled in this art using usual experimental methods, however, some basic guidelines are provided herebelow.

The rate of silver halide growth (Å/sec) is relatively low at a pH of about 4.6, thus, in this pH range, the rate at which the concentration of the salt solutions are increased is low. If the concentrations of the salt solutions are increased too quickly at this pH, fresh nuclei for silver halide grains would be produced. On the other hand, at a pH of about 11, the growth rate is relatively high and so is the rate at which the concentrations of the salt solutions are increased.

The growth rate (Å/sec) also varies as a function of the silver ion concentration. In this case, the growth rate is relatively high at a pAg of about 5.5, but it then decreases until pAg of about 8.1 is reached, after which it continuously increases. Thus, if grain growth is carried out at a pAg of about 8.1, the rate with which the concentrations of the salt solutions are increased will be relatively low, whereas at about 5.5, the salt solution concentrations can be more rapidly increased.

The solubility of the silver halide crystal also influences the grain growth rate. The higher the solubility is, the higher the growth rate is and the greater is the rate with which the salt solution concentrations can be increased. The grain growth rate is also affected by the colloid concentration. At concentrations on the order of 1 to 2%, the growth rate is low but it increases quickly and levels off such that at colloid concentrations on the order of 4% or greater, the grain growth rate is high and the rate with which the salt solution concentrations are increased can be high.

Grain size is roughly inversely proportional to the growth rate such that at large grain sizes (greater than about 0.5μ), the growth rate is low and at small grain sizes (less than about 0.5μ), the growth rate is high. Thus, when the grain size is large, the rate with which salt solution concentrations are increased is low, whereas when the grain size is small, the concentration rate increase can be high.

The grain density (number of grains per liter) also affects the growth rate. When the grain density is low, the growth rate is low and when it is high so is the growth rate high. The relationship is not quite linear. However, when the density is less than $1\times10^{13}$ grains/l, the rate is relatively low and above that density, it is high.

The affect of the stirring speed on growth rate is that when the speed is slow the growth rate is low and when it is high the growth rate is high. The relationship again is not quite linear but the exact relationship can be determined by one skilled in the art using normal experimental techniques.

As can be seen from the above, the crystal growth rate depends on a combination of factors. The important consideration at all times and the finding which underlies the present invention is that as grain growth proceeds, a larger grain surface is available for growth and, thus, to achieve a high or the maximum "critical crystal growth rate" (as described in Wey and Strong, infra), the concentrations of the salt solutions should be increased from the concentration at the initial stage of grain formation, provided fresh nuclei are hardly produced.

Namely, a concentration slightly lower than the concentration at which the production of fresh nuclei of crystal grains becomes possible may be taken as an upper limit on the concentration of the aqueous solutions of inorganic salts during grain growth. Such an upper limit may be determined experimentally on an actual system by ascertaining whether nuclei of crystal grains are freshly produced or not through microscopic observation of specimens obtained by sampling the reaction vessel.

In the present invention, when it is desired that silver halide crystal grains increase in size in a period of time as short as possible and that the size distribution be as narrow as possible and uniform, the number of crystal grains grown should be reduced and the concentration of the aqueous solution of inorganic salts should be increased to at a maximum the concentration at which crystal grain nuclei are not freshly produced. In other words, the inorganic salt aqueous solutions are added such that the concentration of the inorganic salts present in the reaction vessel at each stage of grain growth is maintained at a relatively high concentration in the range of about 70% or more and less than 100% of the critical super saturation concentration.

Furthermore, when silver halide crystal grains having a relatively small size and exhibiting a relatively narrow size distribution are desired, the number of crystal grains to be grown should at first be increased and then the aqueous solutions of inorganic salts should be added at concentrations that are at the most in the range where crystal grain nuclei are not freshly produced (i.e., about 70% or more and less than 100% of the critical super saturation concentration).

If the total amount of inorganic salts added during the period of nuclei formation and during the period of grain growth is a fixed number, the lower the number of grain nuclei produced, the larger the grain size becomes during grain growth. Accordingly, when a large grain size is required, the concentrations of the aqueous solutions of inorganic salts at the start of addition should be made as low as possible.

The term "such that fresh grain nuclei are hardly produced" as used in this specification means that the weight of grain nuclei freshly produced is less than 20% and preferably less than 5%, of the weight of grain nuclei originally present or produced during the period of nuclei formation.

In the present invention, the concentrations of aqueous solutions of inorganic salts to be added can be varied over a wide range from the beginning to the end of grain growth. A lower limit of the concentration of the aqueous solutions of inorganic salts at the beginning of nuclei formation is about 0.001 to 0.1 mole/l, and in the final stage of grain growth the concentration of the aqueous solutions of inorganic salts can be raised to about 0.5 to 5 mole/l or up to the solubility limit of inorganic salts used. In addition, the concentration of the aqueous solutions of inorganic salts added at the final stage of grain growth ranges from 5 to 20,000 times the concentration of the aqueous solutions of inorganic salts added at the initial stage of grain growth and preferably it is 20 to 2,000 times the concentrations at the initial stage of grain formation.

Moreover, in the present invention, the concentration of aqueous solutions of inorganic salts can be changed continuously or step-wise with grain growth. Furthermore, the quantity of inorganic salts added to a reaction vessel in a unit time can be sharply increased by increasing the rate of addition of the aqueous solutions of inorganic salts into a reaction vessel and, at the same time, using higher concentrations of aqueous solutions of inorganic salts. The manner in which the concentration is increased is chosen to provide the crystal grains desired with the optimum size and size distribution.

The step-wise increase of the concentration of an aqueous solution of inorganic salt may be carried out in the following manner: each of two or more kinds of aqueous solutions of inorganic salts is added at a concentration of $C_1$ mole/l at an addition rate (flow rate) of $V_1$ l/min over a time interval between the beginning of reaction and a time of $t_1$ minutes to allow a double decomposition reaction to run. Over the next (or second) time interval of $t_2$ minutes it is added in a concentration of $C_2$ with an addition rate of $V_2$ and then over still another time interval of $t_3$ minutes it is added at a concentration of $C_3$ and an addition rate of $V_3$. Optionally, the aqueous solution can be further added under the conditions ($t_4$, $C_4$, $V_4$), ($t_5$, $C_5$, $V_5$), etc. Using step-wise addition, the relation of $C_1<C_2<C_3<C_4<C_5<\ldots<C_i$ must be satisfied, and $V_1$ to $V_i$ may be the same or different from one another. The concentrations and addition rates of two or more of aqueous solutions of inorganic salts may be changed in the same way, or they may be changed in differently as long as the conditions as specified above are satisfied. The number of steps for the addition is preferably 0.3 or more.

Of course, the concentration ($C_i$) at each addition stage ($T_i$) must be such a concentration that it hardly causes the production of fresh grain nuclei even at the initial periods of that addition stage (i), and can be determined by such an experimental method as to be usually carried out, as described hereinbefore.

In the present invention, as examples of the method of increasing continuously the concentration of an aqueous solution of an inorganic salt, mention may be made of the following:

(a) A system as illustrated in FIG. 1 may be employed. Therein, a silver nitrate solution is continuously added from tank A in which a concentrated silver nitrate solution is stored to the tank B in which a dilute silver nitrate solution is contained and thus a continuous increase in the concentration of the silver nitrate solution effusing from the tank B results.

Figure 2:
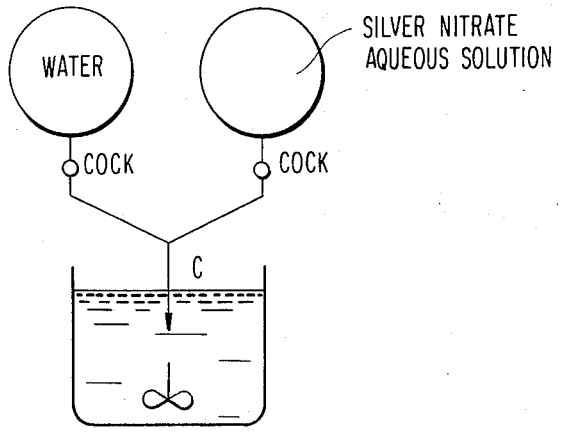

(b) Also, a system as illustrated in FIG. 2 may be employed. Therein, water and a silver nitrate solution ae separately put in respective containers having an injector form, and their addition rates are varied and consequently, the mixing ratio at the point C in FIG. 2 can be changed continuously at the most part to result in the nearly continuous change in the concentration of the aqueous solution of silver nitrate to be added to a gelatin water solution. The solution in the container having an injector form is pressed out using a piston.

In addition, when the concentration of an aqueous solution of an inorganic salt is increased at such a rate that it does not cause the production of fresh grain nuclei, the better the stirring is in the reaction vessel, the higher becomes the rate of the increase in crystal grain size. Namely, a critical growth rate, which is described hereinafter, can be increased, and the probability of reproducing grain nuclei can be lowered.

The stirring may be carried out using a method of addition into liquid in which a mixing chamber is utilized, as disclosed in, for example, German Patent Application (OLS) No. 2,556,885, or using the method of addition into liquid disclosed in U.S. Pat. No. 3,415,650. Also, variously shaped baffle plates and stirring blades may be employed in a reaction vessel. The shape of a reaction vessel may be cylindrical or a squarish box shaped.

In the present invention, grain formation is typically carried out at about 50° to 90° C.

In the case that silver halide grains are made to grow in size according to embodiments of the present invention, it is desirable that the grain growth is carried out under such an atmosphere that the critical growth rate of the grains may be increased. The desirable conditions can be determined by measuring critical growth rates and probabilities of reproducing grain nuclei under various conditions according to methods described in, for example, Wey and Strong, *Photographic Science & Engineering*, Vol. 21, pp. 14–18 (1977).

One of advantages of the present invention is that a pH value in a reaction vessel can be changed over a wide range. The pH value can be selected from a range of 0 to 13 according to the use of the silver halide produced. Usually, a pH range of 8 to 10.5 is used in a preparation of negative type silver halide emulsion and a pH range of 1.0 to 5.0 is used in a preparation of a direct positive silver halide emulsion. These pH ranges are common knowledge.

A preferably pAg value ranges from 1 to 12. The particularly desirable range includes pAg values corresponding to high silver halide solubilities, which solubilities can be determined when silver ion concentration of silver halide, halogen ion concentration of silver halide and silver-halogen ion complex concentration are plotted as a function of pAg (curves obtained by plotting are called the solubility curve). This is because the higher the solubility is, the greater the critical growth rate becomes and the lower the probability of reproducing grain nuclei becomes. From the standpoint of the photographic properties of the silver halide grains prepared under such an atmosphere, pAg values ranging from 5 to 11 are particularly preferred.

A preferable grain density (corresponding to the number of grains present in a volume of 1 liter) ranges from $1\times10^{10}$ to $1\times10^{18}$ grains/l. However, since the higher the grain density is, the lower the probability of producing grain nuclei is and the greater the critical growth rate also is, grain densities not lower than $1\times10^{12}$ grams/l are more preferable. When the total amount of an inorganic salt to be added is a definite value, the lower the number of grains is, the larger the grain size becomes. Therefore, the grain density has an upper limit. Accordingly, a particularly desirable grain density ranges from $1\times10^{12}$ to $1\times10^{17}$ grains/l.

In case gelatin is employed as a protective colloid, a preferable gelatin concentration ranges from 0.1 to 30 wt%, but the critical growth rate decreases and the probability of reproduction of grain nuclei increases as the concentration decreases in the range below 2 wt%. Therefore, a particularly desirable concentration of gelatin is 2 to 20 wt%.

When the light-sensitive silver halide grain is prepared by the method of the present invention and solvents for inorganic salts are employed, the result is to increase the critical growth rate and lower the probability of reproducing grain nuclei. Accordingly, grains having larger size can be obtained herein. Such solvents include, for example, ammonia, thiocyanates, thioether compounds as described in Japanese Patent Application No. 65442/77, corresponding to West German Patent Application (OLS) No. 2,824,082 and to Japanese Patent Application (OPI) No. 1018/1979, silver halide solvents as disclosed in Japanese Patent Application No. 158838/76 published in Research Disclosure, RD-16516, pp. 10–13 (January 1978) and Japanese Patent Application No. 59538/77, etc. corresponding to West German Patent Application (OLS) No. 2,822,320 and to Japanese Patent Application (OPI) No. 144319/1978, and are usually employed in amounts of about 0 to $5\times10^{-1}$ mole/l (reaction vessel).

Furthermore, the present invention can be applied favorably to methods of continuously preparing silver halide emulsions as described in, for example, *Research Disclosure*, Vol. 149, pp. 95–96 (September 1976).

In preparing light-sensitive silver halide emulsions using the method of the present invention, the type of emulsion, washing of emulsion, chemical sensitization, anti-foggants, stabilizers, hardeners, vehicles, antistatic agents, coating aids, spectral sensitizers, dyes, color couplers and so on, other than emulsion constituent elements described hereinbefore, can be selected with reference to descriptions in *Product Licensing Index*, Vol. 92, pp. 107–110 (December 1971).

The present invention will now be illustrated in greater detail by reference to the following examples. However, the invention is not intended to be construed as being limited to these examples. Unless otherwise indicated, all parts, percents, ratios, etc., are by weight.

EXAMPLE 1

A photographic silver bromide emulsion was prepared using a method in which each of the aqueous solution of silver nitrade and the aqueous solution of potassium bromide were added separately in the same amounts, as the same time, and into a stainless steel reaction vessel having a volume of 3 liters into which 15 ml of a 50% aqueous solution of ammonium nitrate, 60 g of gelatin and 900 ml of water had been previously added, and maintained at a temperature of 60° C.

Each of the aqueous solutions of silver nitrate and of potassium bromide was added at the same flow rate of 12 ml/min, and their concentrations were increased step-wise in the following manner. The concentrations were: 1/64 mole/l over the first period of 10 minues, 1/16 mole/l over the second period of 20 minutes, ½ mole/l over the third period of 20 minutes, 2 mole/l over the fourth period of 20 minutes, 3 mole/l over the fifth period of 20 minutes and 5 mole/l over the final period of 20 minutes. In this case, the change in concentration of silver and bromine ions was 320 times. The stirring in the reaction vessel was carried out using a stirring blade revolving at a speed of about 750 rpm over the first period of 50 minutes while over a next period of 60 minutes, it was revolved at about 1,000 rpm.

The silver potential was set at a pAg value of 7.8 in the first period of 30 minutes, and at a pAg value of 9.0 in the next period of 80 minutes.

An average grain size of the thus-obtained silver bromide was 1.05 μm with the standard deviation of 0.031 and fluctuation coefficient of 0.039 and that, the thus-obtained silver bromide had a quite uniform size distribution.

COMPARISON EXAMPLE

For the purpose of comparison with Example 1, addition was carried out so that the amount of inorganic salts added in a unit time may become equal to that of Example 1 using a method in which the concentrations of inorganic salts were constant and the addition flow rate was changed. The addition is illustrated below.

| Time (min) | Concentration (mol/l) | Addition Amount (ml) | Flow Rate (ml/min) |
|---|---|---|---|
| 0–10 | 1/64 | 240 | 12 |
| 10–30 | " | 1,920 | 48 |
| 30–50 | " | 15,360 | 384 |
| 50–70 | " | 61,440 | 1,536 |
| 70–90 | " | 92,160 | 2,304 |
| 90–110 | " | 153,600 | 3,840 |
| | | Total 324,720 | |

Although the total amount of aqueous solutions of inorganic salts added in the total period of 110 minutes was 2,640 ml in Example 1, in this comparison it went up to 324,720 ml. Such an increase in the liquid quantity is of serious disadvantage from the standpoint the equipment which is required. In both Example 1 and the Comparison Example, the value of 1/64 mole/l was selected as the concentration of inorganic salts added in the first period of 10 minutes, because such a low concentration can contribute to decreasing of the number of seed grains, as described in the following Example 2. If the concentration of 1/16 mole/l or higher is employed, the number of seed grains increases. Therefore, the ultimate grain size attained by the same amount of silver addition becomes small. Such a result is undesirable. In addition, in order to increase the flow rate at the latter stage of addition, the pressure applied to the addition system must be increased, and the increased pressure causes serious danger when the solution flies. For instance, there is danger of loss of eyesight when an aqueous solution of silver nitrate flies into an eye. Moreover, on the occasion that aqueous solutions of inorganic salts having a high concentration are added into the liquid with a flow rate of 5 ml/min or lower in an early period of addition, the orifice for addition is stopped with silver halide produced or the diameter of the orifice becomes smaller and thereby grain formation is apt to be influenced by fine dust in water, bubbles in water or the like. Accordingly, difference in the apparatus used and the day when the grain formation is carried out with respect to the flow rate affects the result and consequently, reproducibility of grain formation becomes low.

EXAMPLE 1

Each of photographic silver bromide emulsions were prepared by adding several aqueous solutions of silver nitrate differing in concentration and several aqueous solutions of potassium bromide differing in concentration in sequence in a manner illustrated in Table 1 in the same quantity into a stainless steel reaction vessel having a volume of 3 liters into which 15 ml of a 50% aqueous solution of ammonium nitrate, 30 g of gelatin and 900 ml of water had been previously added, and continually maintained at a temperature of 60° C. The addition of each aqueous solution was carried out over five or six steps, wherein the total addition amount was the same in each case.

TABLE 1

| Sample | Step I 0–10 Min (mol/l) | Step II 10–20 Min (mol/l) | Step III 20–30 Min (mol/l) | Step IV 30–40 Min (mol/l) | Step* V (mol/l) | Step* VI (mol/l) | Ultimate Size Obtained (μm) | Grain Size Distribution (variation coefficient) (%) |
|---|---|---|---|---|---|---|---|---|
| a | 1 | 1 | 1 | 1 | 1 | — | 0.15 | 10 |
| b | ¼ | ½ | 1 | 1 | 1 | — | 0.23 | 8 |
| c | 1/16 | ⅛ | ¼ | ½ | 1 | — | 0.32 | 6 |
| c | 1/64 | 1/16 | ⅛ | ¼ | ½ | 1 | 0.71 | 4 |

*a: 10 min, b: 29 min, c: 41 min, d: 10 min
**41 min

Therein, grain formulation was carried out in each case under conditions of the setting silver potential of pAG=7.8, the addition flow rate of 15 ml/min and the revolution number of 750 rpm.

The ultimate grain size of silver bromide obtained was set forth in the table. It can be apparently understood that the lower the concentration of the aqueous solutions of inorganic salts at the period of nuclei formation (i.e., early stage of Step I) is, the larger the ultimate grain size obtained becomes. This is because the number of seed grains produced is reduced at the lower concentrations of the aqueous solutions of inorganic salts at the stage of producing grain nuclei.

While the invention has been described in detail and with reference to specific embodiments thereof, it will be apparent to one skilled in the art that various changes and modifications can be made therein without departing from the spirit and scope thereof.

What is claimed is:

1. A method of preparing light-sensitive silver halide grains by the simultaneous addition of two or more aqueous solutions of inorganic salts in the presence of a protective colloid to form a reaction mixture which comprises providing nuclei of silver halide grains at the initial stage of grain formation and growing said grains while increasing the concentrations of said aqueous solutions of said inorganic salts without increasing the concentrations of said inorganic salts in said reaction mixture such that fresh nuclei of crystal grains are hardly produced during the period of grain growth.

2. The method of claim 1, in which nuclei are initially formed by the addition of said solutions and said period of nuclei is 1/5 or less the total period of grain formation.

3. The method of claim 2, in which said period of nuclei formation is 1/50 or less the total period of grain formation.

4. The method of claim 1, in which the concentrations of said aqueous solutions of inorganic salts at the final stage of addition are 5 to 20,000 times those employed at the initial stage of addition.

5. The method of claim 4, in which the concentrations of said aqueous solutions of inorganic salts at the final stage of addition are 20 to 2,000 times those employed at the initial stage of addition.

6. The method of claim 1, in which the concentrations of said aqueous solutions of inorganic salts are increased step-wise.

7. The method of claim 6, in which the concentrations are increased over three or more steps.

8. The method of claim 1, in which the concentrations of said aqueous solutions of inorganic salts are increased continuously.

9. The method of claim 1, in which the density of said silver halide grains is $1\times10^{10}$ to $1\times10^{18}$ grains per liter.

10. The method of claim 9, in which said density is $1\times10^{12}$ to $1\times10^{17}$ grains per liter.

11. The method of claim 1, in which one of said salts is a silver salt and the other is the salt of a halide.

12. The method of claim 1, in which said concentrations of said aqueous salt solutions are increased to at a maximum, less than the concentrations at which the production of fresh grain nuclei is possible.

13. The method of claim 1, in which said concentrations are increased to a range of about 70% or more but less than 100% of critical super saturation.

* * * * *